US009905377B2

(12) United States Patent
Pisu et al.

(10) Patent No.: US 9,905,377 B2
(45) Date of Patent: Feb. 27, 2018

(54) CIRCUIT BREAKER

(71) Applicant: ABB Technology AG, Zurich (CH)

(72) Inventors: Francesco Pisu, Birmenstorf (CH); Fredrik Lundqvist, Remetschwil (CH); Jakub Korbel, Baden (CH); Johan Costyson, Wettingen (CH); Kansara Krunal, Vadodara (IN); Mattias Runnberg, Saxdalen (SE); Sami Kotilainen, Niederrohrdorf (CH); Raphael Rijo-Rude, Baden (CH)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/148,466

(22) Filed: May 6, 2016

(65) Prior Publication Data

US 2016/0329164 A1 Nov. 10, 2016

(30) Foreign Application Priority Data

May 7, 2015 (EP) ..... 15166784

(51) Int. Cl.

| | |
|---|---|
| ***H01H 1/06*** | (2006.01) |
| ***H01H 1/38*** | (2006.01) |
| ***H01H 33/02*** | (2006.01) |
| ***H01H 1/50*** | (2006.01) |

(52) U.S. Cl.

CPC ..... *H01H 1/06* (2013.01); *H01H 1/385* (2013.01); *H01H 1/50* (2013.01); *H01H 33/02* (2013.01)

(58) Field of Classification Search

CPC ..... H01H 1/385; H01H 1/50; H01H 1/06
USPC ..... 200/279
See application file for complete search history.

(56) References Cited

U.S. PATENT DOCUMENTS

2009/0272636 A1* 11/2009 Isberg ..... H01H 1/06 200/279
2015/0248976 A1* 9/2015 Pisu ..... H01H 1/38 218/18

FOREIGN PATENT DOCUMENTS

| | | | | |
|---|---|---|---|---|
| CH | 631026 A5 | | 7/1982 | |
| DE | 4212740 | * | 10/1993 | ..... H01H 1/38 |
| DE | 4212740 A1 | | 10/1993 | |
| EP | 2731116 A1 | | 5/2014 | |
| WO | 2014075992 A1 | | 5/2014 | |

OTHER PUBLICATIONS

European Patent Office, Extended Search Report issued in corresponding Application No. 15166784.7, dated Aug. 13, 2015, 6 pp.

* cited by examiner

*Primary Examiner* — Edwin A. Leon
*Assistant Examiner* — Iman Malakooti
(74) *Attorney, Agent, or Firm* — Taft Stettinius & Hollister LLP

(57) ABSTRACT

The invention relates to a circuit breaker comprising a first and a second contact assembly, wherein one of the contact assemblies comprises contact fingers arranged in a finger cage configuration and the other contact assembly comprises a tube or rod contact. The contact fingers comprise an impact point where the tube or rod impacts the contact fingers for the first time during electrical connection establishment, and a contact zone which contacts the tube or rod when the electrical connection is established. The contact zone comprises two contact points separated from one another and arranged on a line which is perpendicular to the longitudinal axis.

26 Claims, 2 Drawing Sheets

CIRCUIT BREAKER

TECHNICAL FIELD

Figure 1:
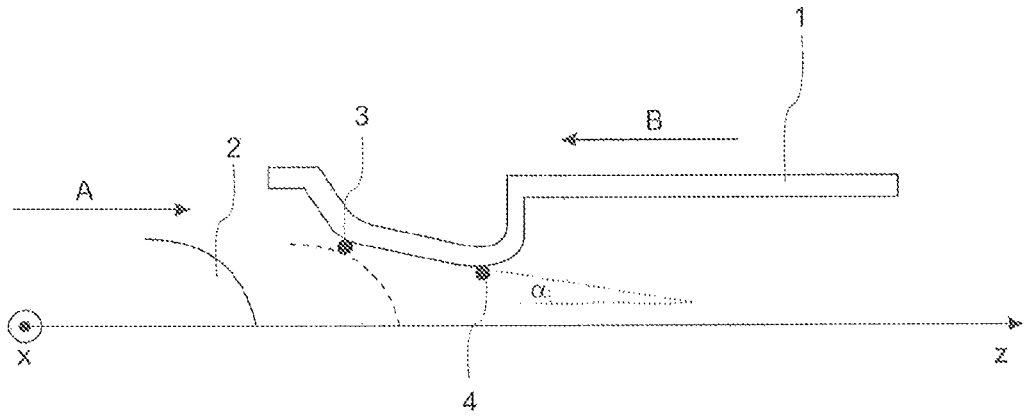

The invention is in the field of medium and high voltage switching technologies and relates to circuit breakers according to the independent claims.

BACKGROUND

Circuit breakers are well known in the field of high and medium voltage switching devices. They comprise nominal contacts and arcing contacts used to open and close the electrical connection. During the opening and closing operations of the circuit breaker the current commutates between the nominal and the arcing contacts and vice-versa, respectively. For these operations at least one nominal contact and one arcing contact move with respect to their respective mating contacts. It is also possible that both nominal and arcing contacts move towards one another.

During the closing procedure first the arcing contacts are connected and after that the nominal contacts. Typical configurations of nominal contacts involve a tube or a rod as a first nominal contact and contact fingers arranged in a so-called finger cage (typically rotational symmetric to a longitudinal axis of the circuit breaker) as the second nominal contact. Consequently, the tube or rod is driven into the finger cage and its outer surface contacts the contact fingers.

During the contacting process the contact fingers have an impact point, in which the first mechanical contact to the tube or rod occurs, whereafter the contact fingers slide on the surface of the tube or rod up to a contact point on their surface, which represents the electrical connection when the circuit breaker is in a contact-closed (i.e. conducting) state. The impact point and the contact point are different from one another.

When the contact fingers are very close to the tube or rod, current starts to flow through the two nominal contacts and small arcs are formed at the impact point of the contacts. These arcs create commutation marks in the vicinity of the impact point, which can extend up to the contact point, thus damaging the contacts. Even though the contact fingers can still be used for subsequent operations, they increasingly wear out in the area of the contact point with every new commutation operation.

Description of the Invention

It is an objective of the present invention to improve contact quality in a contact zone of the contact fingers.

In one aspect of the invention this objective is solved by a circuit breaker comprising a first and a second contact assembly cooperating with one another for closing and opening an electrical connection of the circuit breaker, wherein at least one of the contact assemblies is movable along a longitudinal axis of the circuit breaker. One of the contact assemblies comprises contact fingers arranged in a finger cage configuration and the other contact assembly comprises a tube or rod contact. The tube or rod enters the finger cage for establishing an electrical connection and exits the finger cage for disconnecting the electrical connection. The contact fingers comprise an impact point where the tube or rod impacts the contact fingers for the first time during establishing electrical connection, and a contact zone which contacts the tube or rod when the electrical connection has been established. The contact zone comprises two contact points separated from one another and arranged on a line which is perpendicular to the longitudinal axis.

By providing two contact points instead of a single one the contacting capability is improved. In embodiments, the two contact points are separated by a dent extending in longitudinal direction and being arranged in such a way that it never contacts the tube or rod.

In embodiments, a distance in the direction of the longitudinal axis between the impact point and the contact points ranges between 5 mm and 12 mm, preferably between 9 mm and 10 mm, and more preferably is about or exactly 9.5 mm. Advantageously, this measure extends the distance between the impact point and the contact points such that damage in the impact point cannot "travel" up to the contact zone, thus further improving contact quality and preventing or at least reducing wear of the contact points.

In a second aspect of the invention the circuit breaker comprises a first and a second contact assembly cooperating with one another for closing and opening an electrical connection of the circuit breaker, wherein at least one of the contact assemblies is movable along a longitudinal axis of the circuit breaker. One of the contact assemblies comprises contact fingers arranged in a finger cage configuration and the other contact assembly comprises a tube or rod contact. The tube or rod enters the finger cage for establishing an electrical connection and exits the finger cage for disconnecting the electrical connection. The contact fingers comprise an impact point where the tube or rod impacts the contact fingers for the first time during electrical connection establishment, and a contact zone which contacts the tube or rod when the electrical connection has been established. A distance in the direction of the longitudinal axis between the impact point and the contact point is greater than 5 mm.

In this way the distance between the contact point and the impact point is increased in order to reduce or avoid pronounced wear of the contact zone or contact point due to the electric arcs mentioned above. Contrary to the present solution, in other existing solutions the impact point is very close to the contact point, with distances ranging between 2 mm and 3 mm.

Preferably, the circuit breaker according to the first and the second aspect of the invention is used as a high voltage single-motion or double-motion or triple-motion circuit breaker.

SHORT DESCRIPTION OF THE DRAWINGS

Figure 2:
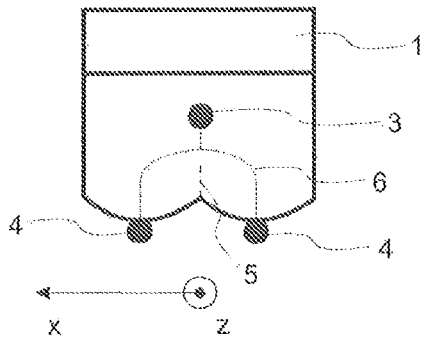
Figure 3:
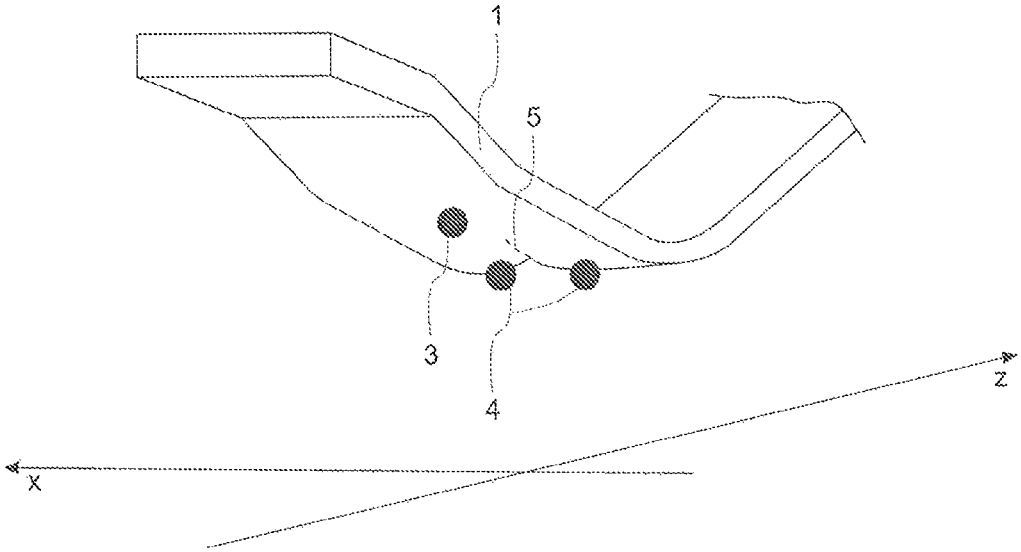

Embodiments, advantages and applications of the invention result from the dependent claims and from the now following description by means of the figures. It is shown in:

FIG. 1 a simplified sectional side view of a tube-type or rod-type nominal contact and a mating contact finger of a circuit breaker according to the invention during a closing operation;

FIG. 2 a simplified front view of a tip of the contact finger of FIG. 1; and FIG. 3 a simplified perspective view of the contact finger of FIGS. 1 and 2.

WAYS OF CARRYING OUT THE INVENTION

In the following same reference numerals denote structurally or functionally same or similar elements of the various embodiments of the invention. It is noted that in the context of this document a contact "point" is not understood as a point in a mathematical sense, but rather as a small area of mechanical contact. The coordinate system is assumed as a polar coordinate system with longitudinal axis z and radial axis x.

FIG. 1 shows a simplified sectional side view of a tube-type or rod-type contact and a mating contact finger of a circuit breaker according to the invention in the process of being closed, i.e. during a closing operation. The closing process is illustrated by arrows A and B showing the movement direction of contact finger 1, which is representative of the first contact assembly 1 comprising a finger cage arranged around longitudinal axis z, and of rod 2, which is representative of the second contact assembly 2. The first and the second contact assemblies 1, 2 are nominal contact assemblies of the circuit breaker.

Furthermore, rod 2 is shown with a dashed line in the instant of impacting the contact finger 1 in the impact point 3. The figure also shows contact zone 4 (i.e. contact point or contact points 4), representing the contact position of the two assemblies 1, 2 in a closed configuration of the circuit breaker.

The contact fingers 1 are shaped in such a way that they form an angle $\alpha$ with respect to the longitudinal axis z in an area between impact point 3 and contact points 4, which angle $\alpha$ ranges between 10° and 30°, particularly is substantially or exactly 20°. The angle $\alpha$ is chosen in said range for the following reasons. Firstly, a slope of the contact finger 1 shall not be too steep in order to keep an impact force between rod 2 and finger 1 as small as possible and thus to prevent deformations of contact finger 1. Secondly, angle $\alpha$ shall not be too small such that a good electrical contact is ensured in closed state of the circuit breaker. Finally, the angle $\alpha$ shall not be too small in order to keep finger dimensions reasonable. Said range for angle $\alpha$ shall encompass different slopes, amongst others depending on geometry of the contact assemblies 1, 2 and depending on the speed of the contacts 1 and 2 at the moment of impact.

In embodiments, a distance in the direction of the longitudinal axis z between impact point 3 and contact points 4 is greater than 5 mm. In embodiments this distance ranges between 5 mm and 12 mm. Preferably, the distance is about or exactly 9.5 mm.

In embodiments, all contact points 4 of all contact fingers 1 of the finger cage are arranged at said distance from the respective impact points 3. In this way it is possible to protect the contact area from damage caused by electric arcs in and around impact point 3 by increasing the distance of the contact points 4 from the impact point 3 and at the same time maintaining the optimum angle $\alpha$ of the slope between them. In contrast, as mentioned above, present solutions have only a very small distance between impact point and contact point of approximately 2 mm to 3 mm.

An area of the contact fingers 1, which is located between impact point 3 and contact points 4, forms a substantially plane surface towards the location or region of the impact point 3. In the present context the term "substantially plane" is understood in the way that this surface may also be slightly curved. A curved surface follows the substantially plane surface towards the region or location of each one of the contact points 4. This is best seen in FIG. 3.

FIG. 2 shows a simplified front view of a tip of the contact finger 1 of FIG. 1, as seen in the direction of arrow A (FIG. 1). The contact points 4 are arranged in the direction of the x-axis, i.e. are arranged on a line perpendicular to the longitudinal axis z. Contact finger 1 comprises at least two contact points 4, in particular exactly two contact points 4. In embodiments, the contact points 4 are at a distance of about 6 mm from one another. This distance may vary depending on parameters, such as the dimensions of the contact finger 1.

The contact points 4 of the contact zone are separated by a dent or indentation or groove 5. The dent 5 is arranged in such a way that it never contacts the tube or rod 2. The dent 5 is preferably of elongated shape, being slightly bent away from the longitudinal axis z (at angle $\alpha$, bent away in a radial direction), i.e. at an angle $\alpha$ to the longitudinal axis z; however it may also have other shapes. The depth of the dent 5 in the material of the contact finger 1 is preferably about 0.5 mm, and its length is preferably between 7 mm and 8 mm.

FIG. 3 shows a simplified perspective view of the contact finger 1 of FIGS. 1 and 2. In this figure dent 5 is best seen in connection with the arrangement of the contact points 4. As can be seen, the area around the impact point 3 is substantially plane and merges with a curved area around dent 5. Dent 5 is therefore sunken into the material of contact finger 1 and flanked by two protrusions, each encompassing one of the contact points 4.

In embodiments, a material of impact point 3 differs from a material of contact points 4. Specifically, the area comprising impact point 3 may be made of or coated with a metal which is more resistant to electric arcs, whereas the area of the contact points 4 may be made of and/or be coated with a metal with a high electrical conductivity.

In embodiments, the contact fingers 1 comprise each a spring (not shown) pushing the respective contact finger 1 substantially towards the contact points 4. In this way it is made sure that, besides the natural stiffness of the contact finger 1 itself, the contact fingers 1 are pushed towards the contacting area and thereby ensure a reliable electrical connection in the closed state of the circuit breaker and avoid bouncing of contact fingers 1 on the tube or rod 2 during connection establishment.

During the closing process of the contact assemblies 1, 2 of this example, first the contact fingers 1 impact rod 2 in impact point 3. After that, the contact fingers 1 are further moved in direction B, such that they are elastically bent upwards by the rounded tip of rod 2 by a ratio given by the slope between impact point 3 and contact points 4 (angle $\alpha$). Their stiffness and the above mentioned springs make sure the fingers contact rod 2 constantly. The movement of the contact fingers 1 is stopped when a final position of the contact finger 1 has been reached, in which position the contact fingers 1 reside on the rod 1 surface in contact points 4. The path of an entire sliding area of fingers 1 is shown schematically in FIG. 2 by the dotted path designated by reference symbol 6. The line starting at impact point 3 is straight, because the corresponding surface is plane (as mentioned above), followed by a curved path representing a transition between the flat area and the curved area encompassing contact points 4. This section is followed by a straight path leading to the contact points 4 and representing a "peak" of the curved area.

In the second aspect of the invention only one contact point 4 is provided. Accordingly, no dent 5 exists in this embodiment. This second embodiment is characterized by the augmented distance of at least 5 mm in the direction of the longitudinal axis z between the impact point 3 and the contact point 4. The distance in the direction of the longitudinal axis z preferably ranges between 5 mm and 12 mm and is preferably chosen to be about or exactly 9.5 mm, like in case of the first embodiment of the circuit breaker.

Certainly, also in this case all contact points 4 of all contact fingers 1 of the finger cage are arranged at said distance from the impact point 3.

The solutions proposed in the present invention have the advantage of improving the electrical contact between mating contacts of the circuit breaker.

This is achieved in the first aspect of the invention by providing at least two contact points instead of one. In this way wear of the contact finger surface due to electrical arcs produced in the vicinity of the impact point doesn't affect the entire contact area as much as in case when this area is reduced to half (as in case of a single contact point). A further desired side effect of having two contact points 4 is that upon connection the contact finger automatically centers itself on the curved surface of the rod or tube.

Therefore the probability that the contact finger 1 slides in x-direction on the rod 2 is further reduced. This not only prevents damage of the contact fingers but also makes sure that the contacting with the rod occurs in the defined contact area or at the defined contact points, respectively.

In the second aspect of the invention, which applies also to circuit breaker configurations having contact fingers with only one contact point, this is reached by increasing the distance between the impact point and the contact point. It is emphasized that the solution of the second aspect can also be combined with the solution of the first aspect of the invention to further improve contact quality and endurance.

While there are shown and described various embodiments of the invention, it is to be distinctly understood that the invention is not limited thereto but may otherwise variously be embodied and practised within the scope of the following claims. Therefore, terms like "preferred" or "in particular" or "particularly" or "advantageously" etc. signify optional and exemplary embodiments only.

LIST OF REFERENCE NUMERALS

1 first contact assembly, contact finger(s)
2 second contact assembly, rod, tube
3 impact point
4 contact point, contact points
5 dent
6 sliding path of contact finger
z longitudinal axis
x radial axis.

The invention claimed is:

1. A circuit breaker comprising a first contact assembly and a second contact assembly cooperating with one another for closing and opening an electrical connection of the circuit breaker, wherein at least one of the contact assemblies is movable along a longitudinal axis of the circuit breaker, wherein one of the contact assemblies comprises contact fingers arranged in a finger cage configuration and the other contact assembly comprises a tube or rod contact, wherein the tube or rod enters the finger cage for establishing an electrical connection and exits the finger cage for disconnecting the electrical connection, wherein the contact fingers comprise an impact point where the tube or rod impacts the contact fingers for the first time during electrical connection establishment, and a contact zone which contacts the tube or rod when the electrical connection has been established, and the contact zone comprises two contact points separated from one another and arranged on a line which is perpendicular to the longitudinal axis.

2. The circuit breaker according to claim 1, wherein the contact points of the contact zone are separated by a dent extending in the longitudinal direction, wherein the dent is arranged in such a way that it never contacts the tube or rod.

3. The circuit breaker according to claim 1, wherein a distance in the direction of the longitudinal axis between the impact point and the contact points is greater than 5 mm.

4. The circuit breaker according to claim 3, wherein all contact points of all contact fingers of the finger cage are arranged at said distance from the impact point.

5. The circuit breaker according to claim 1, wherein the contact fingers are shaped in such a way that they form an angle with respect to the longitudinal axis in an area between the impact point and the contact points, which angle ranges between 10° and 30°.

6. The circuit breaker according to claim 1, wherein an area of the contact fingers which is located between the impact point and the contact points forms a substantially plane surface towards a location of the impact point and a curved surface following the substantially plane surface towards a location of each one of the contact points.

7. The circuit breaker according to claim 1, wherein a material of the impact point differs from a material of the contact points.

8. The circuit breaker according to claim 1, wherein the contact fingers comprise each a spring pushing the respective contact finger substantially towards the contact points.

9. The circuit breaker according to claim 1, wherein the first and the second contact assemblies are nominal contact assemblies of the circuit breaker.

10. The circuit breaker according to claim 1, wherein the contact fingers have precisely two contact points.

11. The circuit breaker according to claim 1, wherein the contact points are at a distance from one another ranging between 4 mm and 8 mm.

12. The circuit breaker of claim 1, wherein the circuit breaker is configured as one of a high voltage single-motion circuit breaker or a high voltage double-motion circuit breaker or a high voltage triple-motion circuit breaker.

13. The circuit breaker of claim 2, wherein the dent is 7 mm to 8 mm long.

14. The circuit breaker according to claim 2, wherein a distance in the direction of the longitudinal axis between the impact point and the contact points is greater than 5 mm.

15. The circuit breaker according to claim 1, wherein the contact fingers are shaped in such a way that they form an angle with respect to the longitudinal axis in an area between the impact point and the contact points, which angle is substantially 20°.

16. The circuit breaker according to claim 2, wherein an area of the contact fingers which is located between the impact point and the contact points forms a substantially plane surface towards a location of the impact point and a curved surface following the substantially plane surface towards a location of each one of the contact points.

17. The circuit breaker of claim 1, wherein the impact point is spaced apart from the each of the two contact points in a direction perpendicular to the longitudinal axis.

18. The circuit breaker of claim 1, wherein a plurality of sliding contact paths are defined by a sliding motion between the finger cage and the tube or rod when the finger cage and the tube or rod are in contact with each other during relative motion along the longitudinal axis between each other;

wherein a first sliding contact path of the plurality of sliding contact paths extends along the finger from the impact point and diverges into second and third sliding contact paths of the plurality of sliding contact paths, the second and third sliding contact paths being spaced apart from the first sliding contact path in a direction perpendicular to the longitudinal axis; and wherein the second sliding contact path and the third sliding contact path culminate respectively in the two contact points.

19. The circuit breaker of claim 1, wherein a plurality of sliding contact paths are defined by a sliding motion between the finger cage and the tube or rod when the finger cage and the tube or rod are in contact with each other during relative motion along the longitudinal axis between each other;

wherein the contact between the finger and the tube or rod diverges at or after the impact point on the finger into two sliding contact paths spaced apart from each other in a direction perpendicular to the longitudinal axis; and wherein the two contact paths culminate in the respective two contact points.

20. A circuit breaker comprising a first contact assembly and a second contact assembly cooperating with one another for closing and opening an electrical connection of the circuit breaker, wherein at least one of the contact assemblies is movable along a longitudinal axis of the circuit breaker, wherein one of the contact assemblies comprises contact fingers arranged in a finger cage configuration and the other contact assembly comprises a tube or rod contact, wherein the tube or rod enters the finger cage for establishing an electrical connection and exits the finger cage for disconnecting the electrical connection, wherein the contact fingers comprise an impact point where the tube or rod impacts the contact fingers for the first time during electrical connection establishment, and a contact point which contacts the tube or rod when the electrical connection is established, and a distance in the direction of the longitudinal axis between the impact point and the contact point is larger than 5 mm.

21. The circuit breaker according to claim 20, wherein a distance in the direction of the longitudinal axis between the impact point and the contact point ranges between 5 mm and 12 mm.

22. The circuit breaker according to claim 20, wherein all contact points of all contact fingers of the finger cage are arranged at said distance from the impact point.

23. The circuit breaker according to claim 21, wherein all contact points of all contact fingers of the finger cage are arranged at said distance from the impact point.

24. A circuit breaker comprising a first contact assembly and a second contact assembly cooperating with one another for closing and opening an electrical connection of the circuit breaker, wherein at least one of the contact assemblies is movable along a longitudinal axis of the circuit breaker, wherein one of the contact assemblies comprises contact fingers arranged in a finger cage configuration and the other contact assembly comprises a tube or rod contact, wherein the tube or rod enters the finger cage for establishing an electrical connection and exits the finger cage for disconnecting the electrical connection, wherein the contact fingers comprise an impact point where the tube or rod impacts the contact fingers for the first time during electrical connection establishment, and a contact zone which contacts the tube or rod when the electrical connection has been established, and the contact zone comprises two contact points separated from one another and arranged on a line which is perpendicular to the longitudinal axis, wherein the contact fingers have precisely two contact points.

25. A circuit breaker comprising a first contact assembly and a second contact assembly cooperating with one another for closing and opening an electrical connection of the circuit breaker, wherein at least one of the contact assemblies is movable along a longitudinal axis of the circuit breaker, wherein one of the contact assemblies comprises contact fingers arranged in a finger cage configuration and the other contact assembly comprises a tube or rod contact, wherein the tube or rod enters the finger cage for establishing an electrical connection and exits the finger cage for disconnecting the electrical connection, wherein the contact fingers comprise an impact point where the tube or rod impacts the contact fingers for the first time during electrical connection establishment, and a contact zone which contacts the tube or rod when the electrical connection has been established, and the contact zone comprises two contact points separated from one another and arranged on a line which is perpendicular to the longitudinal axis, wherein a distance in the direction of the longitudinal axis between the impact point and the contact points is greater than 5 mm; and wherein all contact points of all contact fingers of the finger cage are arranged at said distance from the impact point.

26. A circuit breaker comprising a first contact assembly and a second contact assembly cooperating with one another for closing and opening an electrical connection of the circuit breaker, wherein at least one of the contact assemblies is movable along a longitudinal axis of the circuit breaker, wherein one of the contact assemblies comprises contact fingers arranged in a finger cage configuration and the other contact assembly comprises a tube or rod contact, wherein the tube or rod enters the finger cage for establishing an electrical connection and exits the finger cage for disconnecting the electrical connection, wherein the contact fingers comprise an impact point where the tube or rod impacts the contact fingers for the first time during electrical connection establishment, and a contact zone which contacts the tube or rod when the electrical connection has been established, and the contact zone comprises two contact points separated from one another and arranged on a line which is perpendicular to the longitudinal axis, wherein an area of the contact fingers which is located between the impact point and the contact points forms a substantially plane surface towards a location of the impact point and a curved surface following the substantially plane surface towards a location of each one of the contact points.

* * * * *